United States Patent [19]

Taguchi

[11] Patent Number: 4,584,924

[45] Date of Patent: Apr. 29, 1986

[54] SILENCER FOR FIREARMS

[76] Inventor: Mitsuo Taguchi, Keskuskato 29, 81100 Kontiolahti, Finland

[21] Appl. No.: 513,120

[22] PCT Filed: Nov. 2, 1982

[86] PCT No.: PCT/FI82/00052

§ 371 Date: Jun. 17, 1983

§ 102(e) Date: Jun. 17, 1983

[87] PCT Pub. No.: WO83/01680

PCT Pub. Date: May 11, 1983

[30] Foreign Application Priority Data

Nov. 3, 1981 [FI] Finland ..... 813466

[51] Int. Cl.[4] ..... F41C 21/18

[52] U.S. Cl. ..... 89/14.4; 181/223; 181/281

[58] Field of Search ..... 89/14 R, 14 B, 14 L, 89/14 D; 181/223, 264, 281

[56] References Cited

U.S. PATENT DOCUMENTS

| | | | |
|---|---|---|---|
| 1,127,250 | 2/1915 | Humm | 89/14.4 |
| 1,482,805 | 2/1924 | Maxim | 89/14 D |
| 2,375,617 | 8/1943 | Bourne | 181/47 |
| 3,500,955 | 3/1970 | Werbell | 181/36 |
| 3,748,956 | 7/1973 | Hubner | 89/14 D |
| 4,167,987 | 9/1979 | Turner | 181/235 |

FOREIGN PATENT DOCUMENTS

| | | | |
|---|---|---|---|
| 2229071 | 11/1973 | Fed. Rep. of Germany . | |
| 981969 | 5/1951 | France . | |
| 1044850 | 11/1953 | France | 181/264 |
| 1387637 | 12/1964 | France . | |
| 150961 | 11/1931 | Switzerland . | |
| 30240 | of 1909 | United Kingdom . | |
| 122613 | 1/1919 | United Kingdom . | |
| 268085 | 3/1927 | United Kingdom | 181/281 |

OTHER PUBLICATIONS

Waffenrevue, No. 28, Mar.-May 1978, Journal-Verlag Schwend, Schwäbische Hall DE, Welrod, pp. 4417-4428.

*Primary Examiner*—Stephen C. Bentley
*Attorney, Agent, or Firm*—McGlew and Tuttle

[57] ABSTRACT

A silencer for the barrel of a firearm comprises a sheath defining an interior space having open opposite ends. The sheath has a longitudinal axis. A plurality of partitioned plates are connected to the sheath and extend across the interior space thereof. Each partition plate has an opening therethrough of a size which is wider than a caliber of the firearm barrel and which lies in a plane which is inclined at an acute angle with respect to the axis. Each partition plate, in a direction along the axis, is rotated around the axis by a selected angle with respect to a previous partition plate to produce a convoluted path for gases discharged from the gun barrel. The first partition plate in the sheath adjacent a firearm valve which is connected to one open end of the sheath, defines an initial expansion chamber for the gases.

4 Claims, 12 Drawing Figures

SILENCER FOR FIREARMS

FIELD AND BACKGROUND OF THE INVENTION

The present invention relates to a silencer for firearms, comprising a tubular sheath, at one end of which sheath there is attached a fixing collar in order to fix the silencer to the gun barrel and at the other end of which sheath there is attached the muzzle of the silencer which is provided with a hole that is wider than the gun caliber. Inside the sheath of the silencer there is arranged preferably an expansion chamber immediately behind the fixing collar and thereafter a plurality of flange-like elements, which are placed at certain intervals from each other and provided with a hole slightly wider than the gun caliber.

The purpose of the silencer is to diminish noise at the muzzle which is caused by the outcoming powder gas, to prevent flame at the muzzle from being visible when shooting in weak light and to keep the air wave which comes from the gun barrel from moving vegetation and from hurling dust and other materials in front of the shooting location, this is important in military practice in order to conceal the position of the shooter.

Several prior art firearm silencers are known which operate by gas powder, for instance the so-called single-chamber silencers. The single-chamber silencer is formed of a tube attached to the gun muzzle and provided with a tap which has a hole slightly larger than the bullet diameter. In the tubular chamber the powder gases expand and the gas flows obstruct each other while the bullet passes through the muzzle tap. A common type of silencer for rimfire rifles is 25 cm long and has an inner diameter of 30 mm. The gap in the muzzle tap is as small as possible, according to the silencer's location in the weapon.

The silencing effect of the above-discribed silencer is, however, small. The effect can be boosted by placing in the chamber, behind a suitable expansion space reserved for powder gases, a plurality of silencing elements such as various partition plates or spiral-like members which are naturally provided with a hole in the middle, the hole being wider than the gun caliber.

The German Publication DE-AS No. 2 229 071 introduces a silencer for firearms, where, within the cylindrical sheath of the silencer, there is adjusted a tubular member which member has a quadrate cross-section. This member is made up of identical parts attached to each other. The adjacent parts are turned 90° with respect to each other in a plane perpendicular to the silencer axis. Each part is formed of two flap-like plates, which are folded toward each other and towards the silencer axis in order to create a wedge-shaped head against the shooting direction of the bullet. An opening which is larger than the gun caliber is arranged at the wedge-like head of each part. The parts are attached to each other in a partially overlapping fashion for example by welding.

Among the drawbacks of the above-described silencer are that the member located within the silencer sheath has a fixed construction and its singlular parts are large. Thus it is impossible to change the separate parts of the silencer, and the device obtains a relatively large size. Moreover, the parts of the member form such an open system the the powder gases have free entry to the space between the sheath and the member. In that case the flowing speed of the powder gases does not decrease quickly enough, wherefore the silencer does not function effectively.

The drawbacks of the prior art silencers can be summarized in that they are too large and heavy in relation to their efficiency. This hampers their use for example as auxiliary equipment in shooting training. Effective silencers are also complex and therefore expensive. Only few silencers can be dismantled for cleaning and possible changing of separate parts.

SUMMARY OF THE INVENTION

The purpose of the present inventation is, among others, to eliminate the above mentioned drawbacks and to realize a silencer which has a simple structure but effective power. This is achieved by providing flange-like silencing elements consisting of partion plates placed at an angle other than 90° with respect to the axis each partition plate being turned, in a perpendicular plane to the silencer axis, a given angle in relation to the previous partition plate.

As regards the advantages of the present invention, the following can be stated. The flange-like silencing elements are constructed of partition plates installed within the silencer sheath, the slope of which plates, with respect to the cross-section plane of the silencer, varies regularly. This prevents the reaction effect of the powder gases, which collide against the partition plates, from deviating the gun from the line of aim. Moreover, the gas flow changes its direction constantly owing to the placing of the partition plates. Thus the flowing velocity of the gas flow is effectively diminished. Those partition plates that are placed at an angle with respect to the silencer axis have a larger surface area than those planced vertically to it. If the partition plates are made of a good heat-conducting material such as aluminium, the powder gases are effectively cooled while passing through the silencer, so that no flame is created at the muzzle.

Compared to the silencers in general use, the silencer of the present invention can be constructed smaller in size and lighter in weight. These advantages are achieved by means of the simple structure and the materials used. A silencer with a small diameter does not hinder sighting through the proper aiming devices of the gun in question, as is the case with many currently used silencers.

The silencer of the present invention, and more particularly a preferred embodiment where the partition plates are separated by means of intermediate collars placed within the sheath, can easily be dismantled for cleaning and possible changing of separate parts. The manufacturing of the partition walls and the intermediate collars is a simple process, wherefore the production costs of the silencer are reasonable, too.

The silencer of the present invention is effective. It silences the noise at the gun muzzle up to 90–95% and roughly 80% of all the noise effects caused by a shot. The major part of the remaining noise consists of the noise caused by the bullet, which cannot be silenced by any generally known means. The bullet noise has a high frequency so that it cannot be heard disturbingly loud far at the sides of the shooting place or behind it. The bullet noise also has a remarkable significance in preventing misuse of a silenced gun.

BRIEF DESCRIPTION OF THE DRAWINGS

In the following the invention will be described in detail with reference to the appended drawings wherein

FIG. 9 shows how the powder gases flow in the silencer of FIG. 3.

DESCRIPTION OF THE PREFERRED EMBODIMENT

Figure 1:
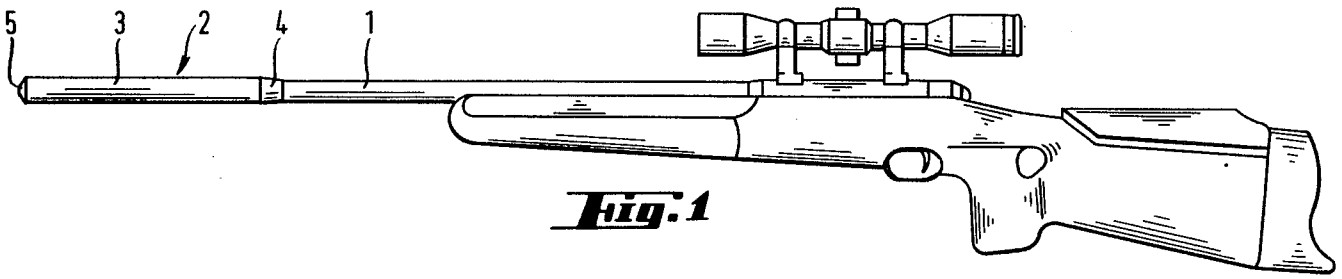
FIG. 1 is an illustration of a silencer according to the invention, mounted on a gun.
Figure 2:
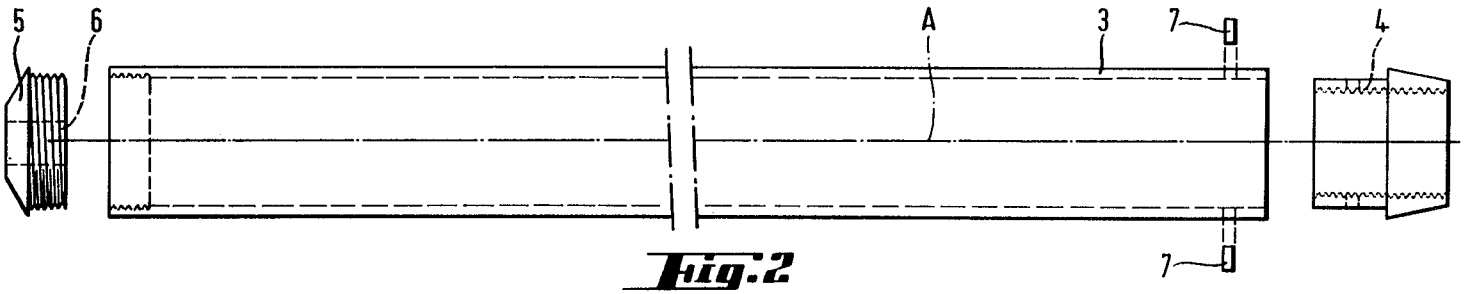
FIG. 2 is an exploded view of the outer parts of the silencer.

FIG. 1 shows a gun with a silencer 2 mounted on the barrel 1. The silencer comprises, as can also be seen in FIG. 2, the tubular sheath 3, the fixing collar 4, by means of which collar the silencer is attached to the gun, and the muzzle tap 5, which is naturally provided with a hole 6 wider than the gun caliber. The fixing collar 4 can be connected to the sheath 3 for example by threading or my means of lock pins 7. On the outer surface of the gun muzzle, as well as on the inner surface of the fixing collar, there are cut reciprocal threads in order to fix the silencer.

Figure 3:
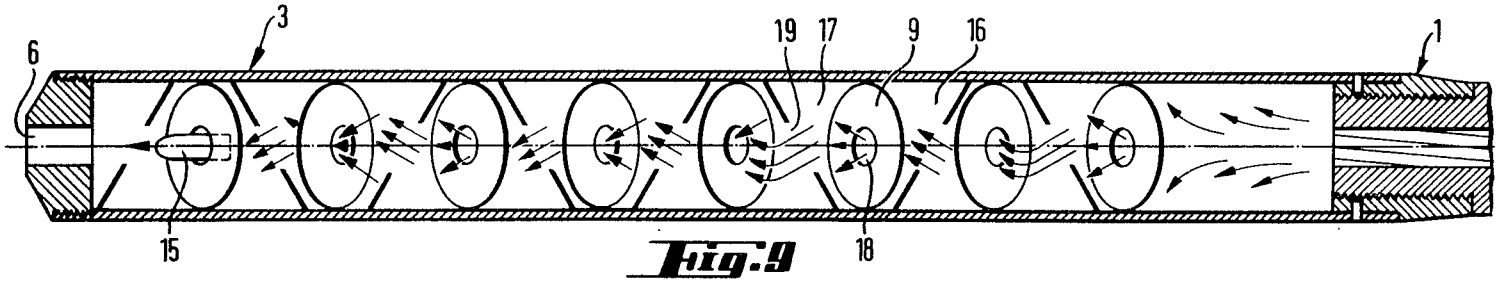
FIG. 3 is a partial cross-section view of one prefered embodiment of the silencer.

FIG. 3 shows that within the sheath 3 of the silencer 2, immediately in front of the fixing collar 4, there is arranged an expansion space 8 occupying a relatively large portion of the volume of the sheath 3, and thereafter a plurality of flange-like silencing elements at certain intervals from each other, the elements being provided with a hole slightly larger than the gun caliber.

The flange-like silencing elements are formed of partition plates 9, 10, which are placed at an angle $\alpha$ other than 90° with respect to the axis A of the silencer 2. Each partition plate is placed at a deviant position with respect to the previous partition plate, so that for example the plate 9′ is turned, in a vertical plane to the silencer axis A, to form an angle, preferably 90° as is seen in FIG. 3, with the plate 9″. In this embodiment of the invention the angle $\alpha=60°$. The partition plates are placed preferably at an angle of 30°–60° with respect to the axis A.

The partition plates 9, 10 can be fitted within the sheath so that each partition plate, compared to the previous plate, is placed, in a perpendicular plane to the silencer axis A, only at an angle of 90° turned either clockwise or counterclockwise, as respectively the plates 9′ and 9″ in FIG. 3, when the partition plates are observed in the bullet's shooting direction.

The partition plates can be divided into groups, as in FIG. 3. In the first group the plates 9′ are turned 90° counterclockwise with respect to the previous plates 9″ in a plane vertical to the silencer axis A. In the second group the partition plates 10′ and 10″ are respectively turned clockwise. There can be several such groups in the silencer.

In the silencer of the invention the powder gases following the bullet 15 are set into screwlike and/or spiral-like motion immediately after the expansion space 8, owing to the partition plates 9, 10, as is seen in FIG. 9. The gases burst out for example from the intermediate space 16 through the gap 18, mainly in vertical direction towards the partition plate 9 and flow to the next intermediate space 17 so that they do not pass directly through the hole 19 but are compelled to flow round through the junction of the partition plate and the sheath 3. Thus the gases receive a rotating, screwlike and/or spiralling motion. The rotating direction of the progressing gases can be either clockwise or counterclockwise, depending on which direction the partition plates are turned with respect to each other, in vertical plane to the silencer axis. An effective silencing is achieved by using a silencer where the rotating direction of gases changes in turns from clockwise to counterclockwise. In this case the kinetic energy of powder gases is effectively absorbed in the silencer.

Figures 3, 4A, 4B, 5A, 5B, 6A, 6B, 7A, 7B, 8A, 8B:
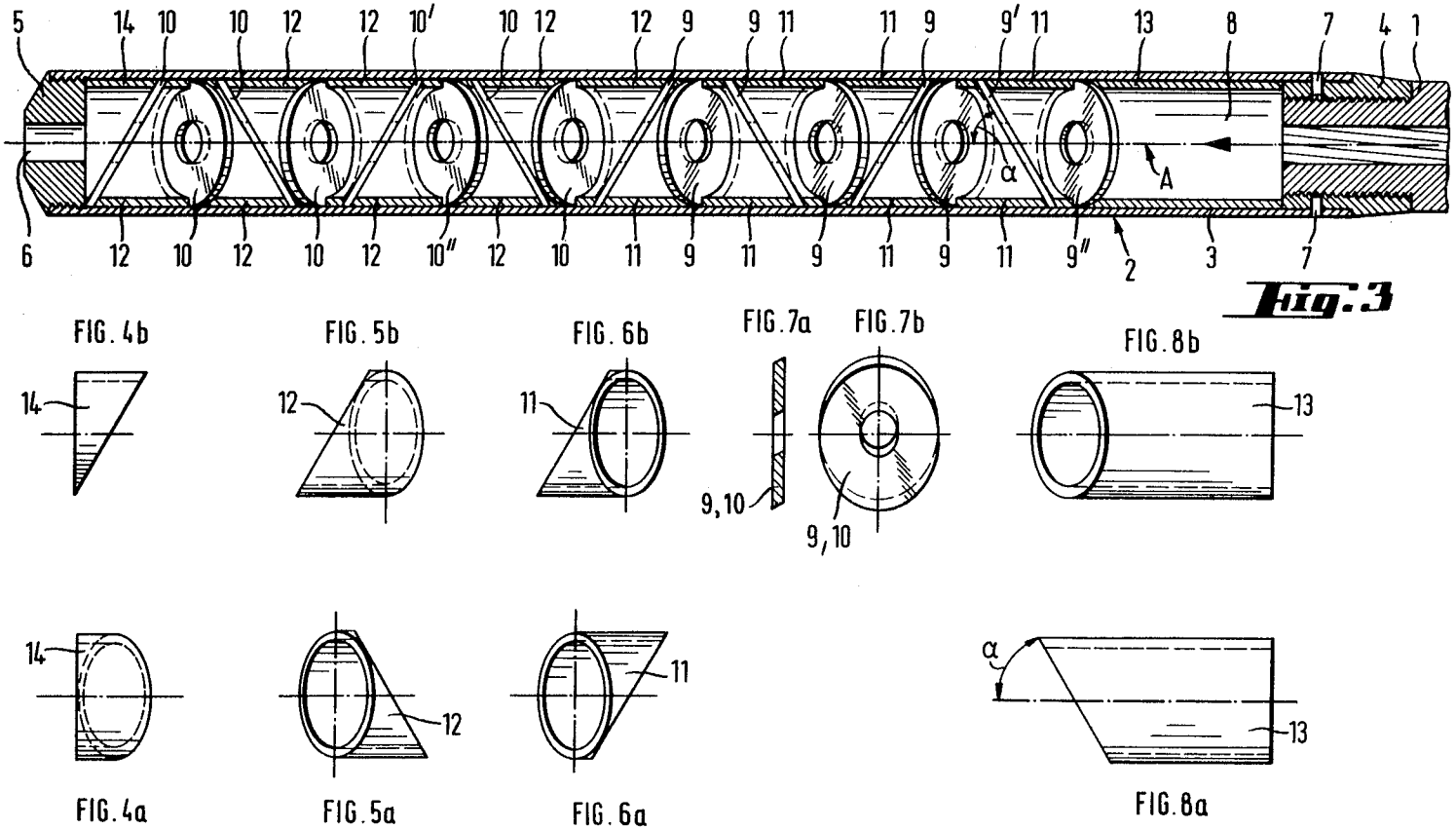
FIG. 4*a* is a top plan view of a collar used in a sheath of the silencer near its muzzle end with FIG. 4*b* being a side elevational view thereof.
FIG. 5*a* is a view similar to FIG. 4*a* of subsequent collars in the sheath, FIG. 5*b* being a side elevational view thereof.
FIG. 6*a* is a view similar to FIG. 4*a* showing a further form of the intermediate collar used in the sheath of the silencer.
FIG. 6*b* being a side elevational view thereof.
FIG. 7*a* is a side sectional view of a partition plate used in the silencer of the present invention.
FIG. 7*b* being a plan view thereof.
FIG. 8*a* is a top plan view of a collar in the sheath meant to be adjacent the muzzle of the firearm barrel, FIG. 8*b* being a side elevational view thereof.

The partition plates 9, 10 have the shape of elliptical plates, provided with a hole for the bullet in the middle, as is apparent from FIGS. 7*a* and *b*. FIG. 7*a* shows the partition plate seen directly from the side and FIG. 7*b* directly from the front. Because the partition plates within the sheath 3 are turned in a slanted position with respect to its axis A, the edges of the partition plates 9, 10 as well as the edges of the holes 18 are worked to be parallel to the axis A. All partition plates are equal.

Each of the partition plates 9, 10 has an outer periphery which is in contact with an interior surface of the sleeve 3 so that each partition plate extends fully across the interior space within the sleeve.

The partition plates 9, 10 of the silencer can be kept apart by means of suitable intermediate members. These are suitably collar-like or tubular members, hereinafter called intermediate collars 11, 12. They are fitted within the sheath 3 in between the partition plates in order to support them. In the preferred embodiment of FIG. 3 are utilized two types of intermediate collars, the first 11 of which, according to FIG. 6, are used to separate such partition plates 9′, which are turned, in vertical plane to the silencer axis A, 90° counterclockwise with respect to the preceding partition plates 9″ and the second 12 of which, according to FIG. 5, are used to separate such partition plates 10′ that are respectively turned 90° clockwise in relation to the preceding partition plates 10″.

The expansion chamber 8 is arranged in the silencer for example by means of a suitable intermediate member such as an intermediate collar or a tubular member 13. The intermediate collar 13 is cut vertically at the end resting against the fixing collar 4, whereas the other end supporting the first partition plate 9″ is cut at a desired angle $\alpha=60°$ with respect to the silencer axis. The fitting member 14 matching the intermediate collar 13 is also placed between the last partition plate and the muzzle tap 5. It has a similar construction as the intermediate collar 13 of the expansion chamber, but it is remarkably shorter, having the same length as the intermediate collars 11, 12.

The above described partition plates 9, 10 and the intermediate collars 11, 12, 13 and 14 have such size that they can without difficulty be fed in due order into the silencer sheath 3. The inner members of the silencer are locked into place by screwing the muzzle tap 5 onto the muzzle. Now the muzzle tap presses the inner members against the silencer fixing collar 4.

All partition plates 9, 10 and the intermediate collars 11–14 can be fed out of the sheath 3 after the muzzle tap 5 has been removed. This makes it possible to clean the inner members 9–14 and the inner surface of the sheath as well as to change damaged parts. Because all parts can be separate, their maintenance and care is utterly simple and easy.

The partition plates 9, 10 and the intermediate collars 11–14 can be made preferably of aluminium or a suitable aluminium commixture, in which case the silencer is built to be light in weight. This also makes it easy to work the parts. In silencers meant for small-calibre firearms the partition plates can be made of a suitable plastic material.

I claim:

1. A silencer for the barrel of a firearm, comprising:

a sheath (3) having an interior surface defining an interior space having open opposite ends, the sheath having a longitudinal axis (A);

a fixed collar (4) connected to said sheath at one open end thereof for connecting said sheath to a firearm barrel;

a plurality of elliptical partition plates (9,10) connected in said sheath and extending fully across said interior space, each partition plate having an opening therethrough of a size wider than a caliber for the firearm barrel and a periphery in contact with said interior surface, each partition plate lying in a plane which is inclined at an acute angle of from 30° to 60° with respect to said axis, each partition plate in a direction along said axis away from said fixed collar being rotated around said axis by a selected further angle of 90° with respect to a previous partition plate;

a first partition plate in said sheath adjacent said fixed collar defining with said sheath an expansion chamber which is larger than a space between other partition plates in said sheath;

a muzzle tap (5) connected to said sheath at an opposite open end thereof and having a hole therethrough;

a first end collar engaged in said sheath having one end lying in a plane perpendicular to said axis and against said fixed collar and an opposite end lying in a plane at said acute angle to said axis, a first of said plurality of partition plates engaged against said opposite end of said collar;

a plurality of intermediate collars each having ends lying in planes at said acute angle to said axis with a plane of one end of each intermediate collar being rotated by said further angle with respect to an opposite end thereof; and a further end collar having one end lying in a plane at said acute angle to said axis and against a last one of said partition plates along said axis, said further end collar having an opposite end lying in a plane perpendicular to said axis and against said muzzle tap whereby said muzzle tap and said fixing collar hold said intermediate and end collars as well as said partition plates together in said sheath, said first mentioned end collar defining said expansion chamber.

2. A silencer according to claim 1, wherein said partition plates are divided into two groups, one of said groups including partition plates which are rotated in a direction along said axis and around said axis clockwise, the other group having plates which are rotated counterclockwise.

3. A silencer according to claim 1, wherein said collars and partition plates are made of one of aluminum and aluminum alloys.

4. A silencer according to claim 1, wherein said partition plates are made of plastic.

* * * * *